United States Patent [19]
Greene
[11] 4,442,777
[45] Apr. 17, 1984

[54] ADAPTOR CARTRIDGE

[76] Inventor: Edward Greene, 1497 Palenville Rd., Saugerties, N.Y. 12477

[21] Appl. No.: 453,133

[22] Filed: Dec. 27, 1982

Related U.S. Application Data

[63] Continuation-in-part of Ser. No. 203,466, Nov. 3, 1980, abandoned.

[51] Int. Cl.[3] ..... F42B 5/22
[52] U.S. Cl. ..... 102/444; 102/447; 42/77
[58] Field of Search ..... 102/444, 445, 446, 447, 102/502; 42/77

[56] References Cited

U.S. PATENT DOCUMENTS

| | | | |
|---|---|---|---|
| 1,902,771 | 3/1933 | Gaidos | 102/446 |
| 1,936,905 | 11/1933 | Gaidos | 102/14 |
| 2,321,737 | 6/1943 | Engel | 102/41 |
| 3,060,856 | 10/1962 | Dunn | 102/41 |
| 3,388,665 | 6/1968 | Koehler | 102/41 |
| 3,598,053 | 8/1971 | Glater | 102/41 |
| 3,611,937 | 10/1971 | Hildebrand | 102/41 |
| 3,640,013 | 2/1972 | Franklin | 102/446 |
| 3,675,576 | 7/1972 | Whitney | 102/44 |
| 3,818,834 | 6/1974 | Baumgartener | 102/41 |

FOREIGN PATENT DOCUMENTS

| | | | |
|---|---|---|---|
| 920472 | 10/1954 | Fed. Rep. of Germany | 42/77 |
| 408214 | 3/1910 | France | 102/444 |
| 1548225 | 11/1968 | France | 102/446 |
| 99973 | 7/1923 | Switzerland | 42/77 |
| 15298 | of 1892 | United Kingdom | 102/444 |
| 24801 | of 1894 | United Kingdom | 42/77 |
| 105706 | 4/1917 | United Kingdom | 42/77 |

*Primary Examiner*—Harold J. Tudor
*Attorney, Agent, or Firm*—John Maier, III

[57] ABSTRACT

An adaptor cartridge permitting the use of rim-fire ammunition in a center-fire weapon. The adaptor comprises a tubular casing with an inner passageway located at an acute angle to the tubular casing at the lower end where the firing pin strikes. The opening of the cylindrically-shaped passage at the lower end crosses the center point of the lower end of the tubular casing so that the centrally-located firing pin of the weapon will strike the rim of an insert blank cartridge which is rim-fired and which has been placed in the adaptor cartridge.

3 Claims, 8 Drawing Figures

ADAPTOR CARTRIDGE

RELATED APPLICATIONS

This application is a continuation-in-part of copending application Ser. No. 203,466 filed Nov. 3,1980, now abandoned.

BACKGROUND OF THE INVENTION

1. Field of the Invention

The present invention relates to adaptor cartridges. More particularly, the present invention is directed to adaptor cartridges of the type permitting the use of low caliber rim-fire blank cartridges as the source of propulsion in weapons designed for higher caliber center-fire cartridges. Accordingly, the general objects of the present invention are to provide a novel and approved adaptor of such character.

2. Description of the Prior Art

Pistol and rifle shooting, particularly in target practice, has become a popular sport. However, when firing on a range it is frequently undesirable to use the ammunition intended for a high caliber weapon. People, for example, firing a 38-caliber revolver may not wish the weapon to have all of the impact and force of a 38-caliber shell. Yet, they desire to practice with such a weapon which is center-fired in order to develop their skill with such a weapon. Perhaps of even greater importance is the fact that the cost of ammunition, particularly for the higher caliber cartridges, is escalating rapidly, thereby making it impractical for many people to do any type of extensive shooting with a high caliber rifle or pistol. It is well-known that rim-fire ammunition, such as blank cartridges can be readily obtained at a substantially lower cost. Preferably such blank cartridges would be 22-caliber but other caliber such as 15-caliber can be utilized.

Many adaptor cartridges have been proposed in the past. These adaptors, although they probably served the function for which they were intended, have been sufficiently complex as to be unduly expensive and also sufficiently complex as to create problems in operation. The major obstacle confronting the design of all the adaptors is the fact that they are using a center-fired weapon with rim-fire cartridges. In order to achieve this result, the inventors have placed the rim-fire cartridges centrally into the center-fire adaptor shell. Sometimes, to do this a shell with a double casing has been formed which is threaded together. Obviously, that is expensive to make and it must be unscrewed and then rescrewed together each time an insert shell is placed into it. With repeated use, problems with the threads must develop and the adaptor cartridge will have to be replaced. In addition, it is time-consuming with such a threaded unit to replace the rim-fire, low-caliber, insert cartridge into the adaptor cartridge. Of even greater importance is the fact that in order to transfer the impact of the firing pin of the center-fire weapon to the rim of the inserted cartridge numerous secondary mechanical means are used, any one of which would readily jam, coorode, refuse to slide properly, wear and otherwise prohibit long and carefree use.

The novel features which are considered as characteristics of the invention are set forth with particularity in the appending claims. The invention itself, however, as to its construction and obvious advantages, will best be understood from the following description of the specific embodiment when read with the accompanying drawings.

SUMMARY OF THE INVENTION

The present invention overcomes the disadvantages of the prior art and in so doing provides a reliable, durable and quickly reloadable adaptor cartridge including a tubular casing with an mouth or projectile end and a head end. The mouth end includes a cylindrical concentrically located opening adapted to receive whatever projectile is being fired, depending upon the caliber of the cartridge adaptor. Extending from the mouth end to the head end, a passageway extends through the tubular casing. The portion of the passageway which receives the projectile is concentrically located with the tubular casing. From the projectile opening to the lower end, the passageway is inclined at an acute angle to the tubular casing. At the head end of the tubular casing, the passageway, which is also cylindrical at that point forms a cartridge chamber for an insert cartridge. The cartridge chamber is so located that the outside circumference of the cartridge chamber at the head end intersects the center point of the tubular casing. In this way, the firing pin of the center-free weapon will strike the rim of the insert cartridge in the cartridge chamber. In view of the dimensions of both the adaptor cartridge and the insert blank cartridge, a portion of the sidewall of the adaptor cartridge is broken away forming an open section which extends into the cartridge chamber from the head end along the tubular casing more than a major portion and less than the entire length of the cartridge chamber.

DESCRIPTION OF THE DRAWINGS

The present invention may be better understood and its numerous advantages will become apparent to those skilled in the art by reference to the accompanying drawings wherein like reference numerals refer to like elements in the various figures in which.

DETAILED DESCRIPTION OF THE INVENTION

Figure 1:
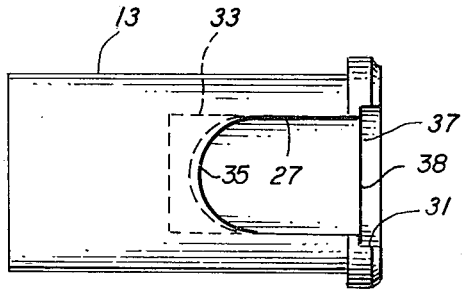
FIG. 1 is a side view of the adaptor cartridge showing the open section of the adaptor cartridge with the insert cartridge partially shown by dotted lines.
Figure 2:
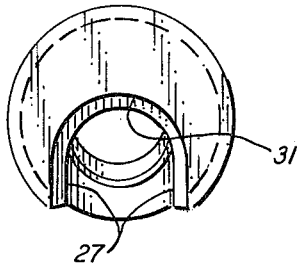
FIG. 2 is an end view of the head end of the adaptor cartridge showing the opening of the cartridge chamber for the insert cartridge.

The adaptor cartridge 11 is formed from a tubular casing 13. The outside shape of the cylindrical or tubular casing 13 conforms to that of the shell originally intended for the weapon to be fired. As for example, if the adaptor cartridge 11 is intended for a 38-caliber revolver, so the cylindrical casing 13 of the adaptor cartridge 11 conforms to the size and shape of a 38-caliber shell.

The tubular casing 13 has a mouth or projectile end 15 and a head end 17. The mouth or projectile end 15 is where the projectile 23 is located and accordingly there is a projectile opening 19 which is concentrically located at the mouth end 15. A passageway 21 extends from the projectile opening 19 to the head end 17. The projectile opening 19 at the mouth end 15 only extends into the tubular casing 13 a sufficient distance to permit the proper fitting of a projectile 23 and is adapted in size to receive the projectile 23.

From the projectile opening 19 to the head end 17, the passageway 21 is inclined at an acute angle to the tubular casing 13. Between the projectile opening 19 and the head end 17, the passageway 21 may be reduced in size. At the head end 17, where the firing primer is normally located in a shell, there is also a cartridge chamber 25.

The cartridge chamber 25 is an extension of the passageway 21 located at an acute angle. The passageway 21 at the head end 17 is also cylindrical but the size of the cartridge chamber 25 is such that the circumference of the cartridge chamber 25 generally passes through the center of the head end 17 of the tubular casing 13. The cartridge chamber 25 at the head end 17 has a diameter which is just slightly larger than the diameter of the blank cartridge 33.

Figure 3:
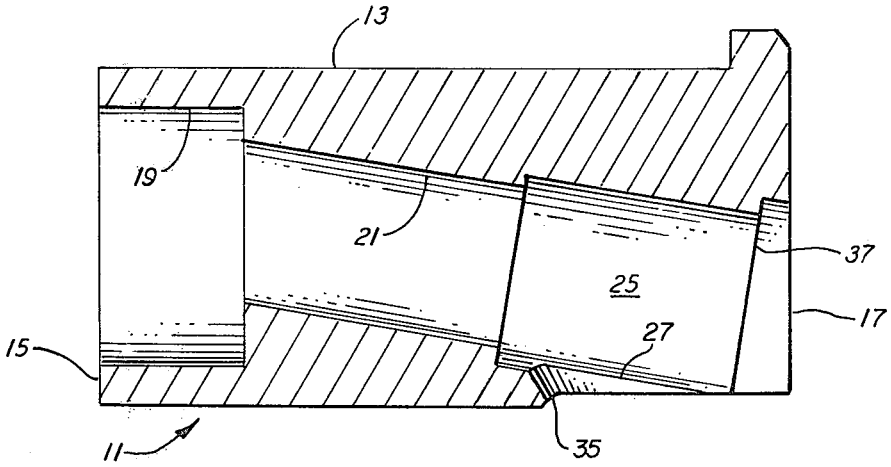
FIG. 3 is a cross-section view along the longitudinal axis of the adaptor cartridge showing the passageway extending from the head end to the mouth end.
Figure 4:
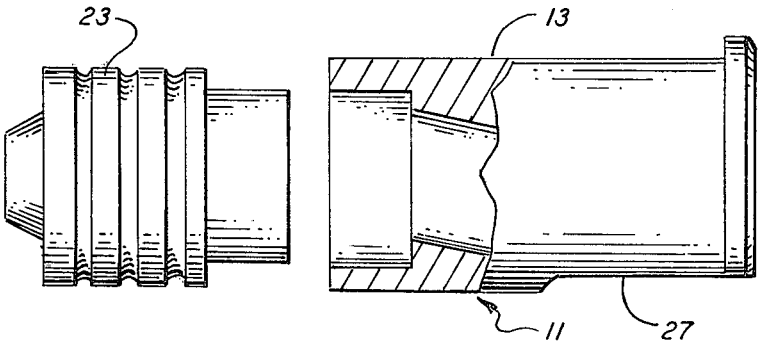
FIG. 4 is a side view of the adaptor cartridge with the projectile outside the adaptor cartridge and with the adaptor cartridge partially broken away.

An open section 27 is located in the side of the tubular casing 13 because the angle of the cartridge chamber 25 is inclined into the side of the tubular casing 13 leaving no wall at the head end 17. The open section 27 is enlarged to remove any weakened material in the tubular casing 13. The open secton 27 as best seen n FIG. 1, is less than the length of the blank or insert cartridge 33 and, as best seen in FIG. 3, the open section 27 extends along the cartridge chamber 25 a major portion of the length of the cartridge chamber 25 from the head end 17 but less than the entire length of the cartridge chamber 25. The end 35 of the open section 27 remote from the head end 17 is rounded to engage the blank cartridge 33. The blank cartridge 33 covers the open section 27.

It has been found that when the center-fired weapon is fired, the insert cartridge 33 expands and fire forms against the remaining portion of the tubular casing 13 thereby sealing the passageway 21.

An anvil 37 is formed about the cartridge chamber 25 at the head end 17 to rest a rim 38 of the blank cartridge 33. The type of shell preferably used as a blank cartridge 33 would be a 22-caliber blank cartridge. Since the rim 37 of the blank or insert cartridge 33 passes sufficiently close to the center point of the head end 17 of the tubular casing 13, the centrally-located firing pin of the center-fire weapon will strike the rim 29 of the rim-fire blank cartridge 33 detonating it directly without the use of any secondary adaptor firing pin.

Figure 5:
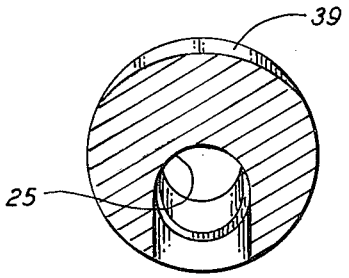
FIG. 5 is a perspective view of the head end showing an optional embodiment of the adaptor cartridge for use with automatic weapons.
Figure 6:
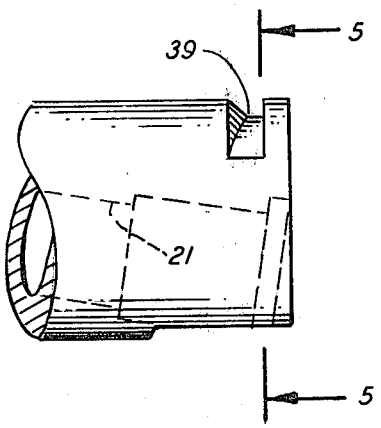
FIG. 6 is a side view of the head end of the adaptor cartridge with the passageway shown in dotted lines and showing the optional embodiment also shown in FIG. 5.

As best seen in FIGS. 5 and 6, an optional embodiment may be utilized with the invention. With repeater weapons, it is necessary to have a circumferentially located groove about the head end 17 of the adaptor cartridge or shell 11 for extracting such shells since such repeater shells for automatic and semi-automatic weapons are rimless. Since the adaptor shell or cartridge 11 has an open section 27 at its head end 17, a complete circumferential groove is not possible. However, a partial groove 39 can be used but the adaptor cartridge 11 must be inserted in the weapon so that the groove 39 is properly aligned with the weapon for automatic firing.

One very important feature of the invention is that the firing pin of the center firing weapon properly strikes the rim of the blank cartridge 33 perfectly. The combination of the passageway 21 being inclined at an acute angle to the tubular casing 13 and the open section 27 makes this possible. Without the open section 27, the blank cartridge 33 would be sufficiently mislocated to prevent proper striking of the rim of the blank cartridge 33.

Figure 7:
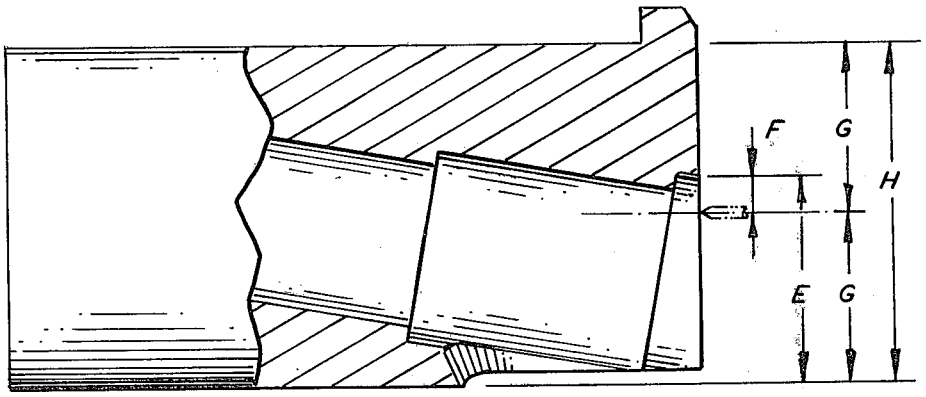
FIG. 7 is a view along the longitudinal axis of the adaptor cartridge cross-sectional at the head end and showing several dimensions of the cartridge adaptor.
Figure 8:
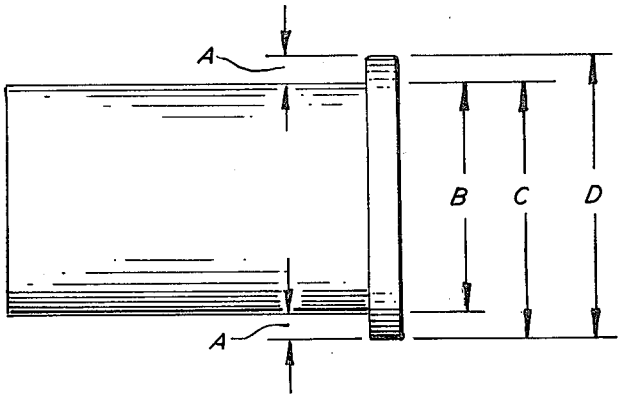
FIG. 8 is a side view of the insert cartridge showing certain dimensions.

As seen in FIG. 7 and FIG. 8, the dimensions of the adaptor cartridge 11 and the blank cartridge 33 are shown. A firing pin 41 for the weapon is shown. The numeral values for various calibers of adaptor cartridges 11 and for a 22-caliber blank cartridge 33 are as follows:

| Blank Cartridge (Dimensions in inches) | |
|---|---|
| A | 0.023 |
| B | 0.224 |
| C | 0.247 |
| D | 0.270 |

| Adaptor Cartridge (Dimensions in inches) | | | | |
|---|---|---|---|---|
| | 45 Caliber | 44 Magnum | 41 Magnum | 38 Caliber .357 Magnum 9MM |
| E | 0.247 | 0.247 | 0.247 | 0.247 |
| F | 0.009 | 0.020 | 0.031 | 0.059 |
| G | 0.238 | 0.227 | 0.216 | 0.188 |
| H | 0.476 | 0.454 | 0.432 | 0.376 |

While a preferred embodiment has been shown and described, various modifications and substitutions may be made without departing from the spirit and scope of this invention. Accordingly, it is understood that this invention has been described by way of illustration rather than limitation.

I claim:

1. A cartridge adaptor for firing a projectile from a center-fired weapon utilizing a rim-fired blank cartridge, said cartridge adaptor comprising:

a tubular casing have a mouth end and a head end, said mouth end having a concentrically-located cylindrical opening for locating a projectile, said tubular casing further having a passageway extending from the projectile opening to the head end, said passageway including a cartridge chamber at the head end and being located at an acute angle to said tubular casing for retaining a rim-fired blank cartridge, the circumference of said cylindrical passageway substantially intersecting the center point of the head end and said tubular casing having an open section along the cartridge chamber adjacent to the head end, said open section extending into the cartridge chamber from the head end along the tubular casing more than a major portion and less than the entire length of the cartridge chamber.

2. A cartridge adaptor according to claim 1 wherein said passageway is reduced in cross-section between said projectile opening and said cartridge chamber.

3. A cartridge adaptor according to claim 1 wherein the open section in the casing along the cartridge chamber has a rounded end and forms a U-shaped opening in the head end of the tubular casing.

* * * * *